United States Patent [19]

Jackson

[11] 4,156,160

[45] May 22, 1979

[54] CATHODE SUPPORT ASSEMBLY STRUCTURE AND FABRICATION

[75] Inventor: Cecil L. Jackson, Seneca Falls, N.Y.

[73] Assignee: GTE Sylvania Incorporated, Stamford, Conn.

[21] Appl. No.: 959,973

[22] Filed: Nov. 13, 1978

Related U.S. Application Data

[63] Continuation of Ser. No. 813,939, Jul. 8, 1977, abandoned.

[51] Int. Cl.[2] ..... H01J 1/88; B21D 39/06

[52] U.S. Cl. ..... 313/292; 29/512; 29/523; 174/152 R; 313/240; 13/268

[58] Field of Search ..... 29/512; 313/292, 243, 313/270, 268, 263, 256, 240

[56] References Cited

U.S. PATENT DOCUMENTS

| | | | |
|---|---|---|---|
| 2,244,358 | 6/1941 | Ewald | 313/270 X |
| 2,680,432 | 6/1954 | Rand | 174/152 S X |
| 3,134,042 | 5/1964 | Sato et al. | 313/270 |
| 3,183,394 | 5/1965 | Hipszer et al. | 313/270 |
| 3,240,978 | 3/1966 | Krawitz | 313/270 |
| 3,244,927 | 4/1966 | Drake et al. | 313/270 |
| 3,333,138 | 7/1967 | Szegho | 313/270 |
| 3,363,136 | 1/1968 | Pakswer | 313/268 |
| 3,465,195 | 9/1969 | Fuchs | 313/270 |
| 3,766,631 | 10/1973 | Scheitlin et al. | 29/512 X |

FOREIGN PATENT DOCUMENTS

| | | | |
|---|---|---|---|
| 899738 | 6/1962 | United Kingdom | 174/152 |

*Primary Examiner*—Alfred E. Smith
*Assistant Examiner*—Charles F. Roberts
*Attorney, Agent, or Firm*—Thomas H. Buffton

[57] ABSTRACT

A cathode support assembly includes an apertured ceramic member, an apertured spring washer, and a dual diameter eyelet having an outwardly crimped portion and a peened end portion exerting a force on the ceramic member and spring washer therebetween. In the fabrication process, the ceramic member and spring washer are telescoped over the eyelet and into contact with the crimped portion and the end of the eyelet is peened into contact therewith to exert a force thereon.

8 Claims, 3 Drawing Figures

CATHODE SUPPORT ASSEMBLY STRUCTURE AND FABRICATION

This is a continuation of an application bearing U.S. Ser. No. 813,939, filed July 8, 1977, now abandoned.

BACKGROUND OF THE INVENTION

In the art of cathode support assemblies and particularly cathode support assemblies of cathode ray tube structures, it has been a common practice to provide a dual diameter eyelet. The eyelet has an outwardly crimped portion and a ceramic washer is telescoped over one end of the eyelet. Thereafter, the same end of the eyelet is peened to capture the ceramic intermediate the peened end and the outwardly crimped portion. A cathode sleeve is normally welded to the opposite end and extends therethrough beyond the ceramic. Moreover, the complete support assembly is attached to an electrode member with the ceramic serving an insulating member therebetween.

Although the above-mentioned cathode support assemblies and method of assembly have been and still are employed with varying degrees of success and satisfaction, it has been found that there are problems encountered with the use of such structures. Specifically, it has been found that attempts to obtain and maintain a tight and firm relationship between the eyelet and the ceramic washer have met with limited success. As a result, the ceramic loosens, either initially or during the life cycle of the structure, and microphonism is encountered. As is well known, microphonism in cathode assembly structures is not a tolerable condition and results in total rejection or at best unsatisfactory performance of such structures.

OBJECTS AND SUMMARY OF THE INVENTION

An object of the present invention is to provide a cathode support assembly which does not exhibit the above-described undesirable features. Another object of the invention is to provide a cathode support assembly having enhanced resistance to microphonics. Still another object of the invention is to provide a cathode support assembly wherein microphonics are reduced. A further object of the invention is to provide a process for fabricating an improved cathode support assembly.

These and other objects, advantages and capabilities are achieved in one aspect of the invention by a cathode support assembly having an eyelet with an outwardly crimped portion, an apertured ceramic member and an apertured spring washer telescoped over the eyelet with the end of the eyelet peened capturing the ceramic member and spring washer intermediate the peened portion and the outwardly crimped portion of the eyelet.

PREFERRED EMBODIMENT OF THE INVENTION

For a better understanding of the present invention, together with other and further objects, advantages and capabilities thereof, reference is made to the following disclosure and appended claims in connection with the accompanying drawings.

Figure 1:
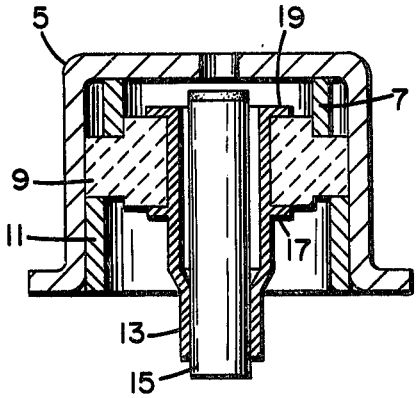
Fig. 1 PRIOR ART
FIG. 1 illustrates a prior art form of cathode support assembly disposed within an electrode suitable for use in a cathode ray tube structure.

Referring to FIG. 1 of the drawings, a prior art form of cathode support assembly included an electrode 5, such as a grid electrode for a cathode ray tube electron gun for example, having a substantially circular metal washer 7 disposed therein. The metal washer 7 serves to space a ceramic member 9 from the end of the electrode 5 and a second metal washer 11 contacts the ceramic member 9 and serves to maintain the positional location of the ceramic member 9 within the electrode 5.

The ceramic member 9 is affixed to a dual diameter eyelet 13. The dual diameter eyelet 13 has one end of a cathode assembly 15 affixed to the inner surface thereof and extending into the electrode 5. The outer surface of the eyelet 13 includes a crimped portion 17 and a peened end portion 19. The ceramic member 9 is captured intermediate the crimped portion 17 and the peened end portion 19 of the eyelet 13.

Figure 3:
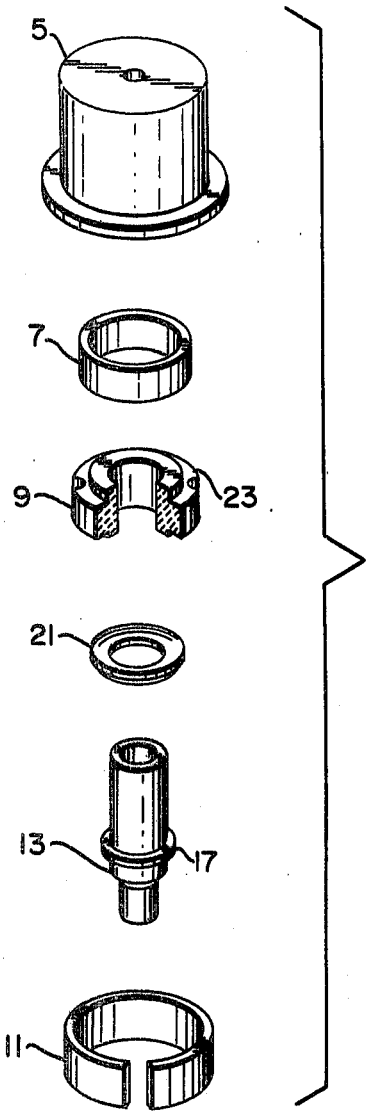
FIG. 3 is an exploded view of the embodiment of FIG. 2.
Figure 2:
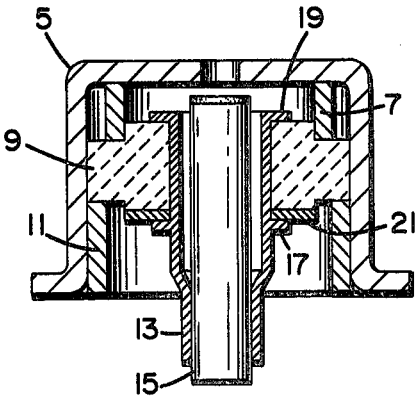
FIG. 2 is a preferred embodiment of a cathode support assembly of the invention.

Referring to the preferred embodiment of FIGS. 2 and 3, the cathode support assembly includes a cathode ray tube grid electrode 5 having a metal spacer washer 7 therein and a ceramic member 9 contacting the spacer washer 7. A second metal washer 11, which is resilient, is disposed within and serves to maintain the ceramic member 9 within the electrode 5.

The ceramic member 9 is affixed to a dual diameter eyelet 13 having a cathode structure 15 attached to one end of the inner surface thereof. The outer surface of the eyelet 13 has a crimped portion 17 and a peened end portion 19. Also, a spring metal washer 21 of a thickness of about 0.010 inches and having a normally curved contour and the ceramic member 9 are disposed intermediate with a force exerted thereon by the crimped and peened end portions, 17 and 19 respectively of the eyelet 13. Thus, the ceramic member 9 and the spring washer 21 are forcibly captured by the crimped and peened end portions 17 and 19.

In the manufacturing process, the dual diameter eyelet 13 has a crimped outer portion 17 and the spring metal washer 21 is telescoped over the eyelet 13. Then, the ceramic member 9 is telescoped over the eyelet 13 and into contact with the spring metal washer 21.

It is to be noted that the spring metal washer 21 has a curved contour and after contact with the crimped outer portion 17 and the ceramic member 9, the end portion of the eyelet 13 is peened to exert a force on and remove the curvature from the spring metal washer 21. Thus, the resiliency of the spring metal washer 21 tends to maintain a force on the ceramic member of an amount sufficient to maintain the ceramic member in a fixed positional location. As a result, the ceramic member 9 does not become loose during operational use and microphonics are either eliminated or at least greatly reduced.

It should be further noted that the ceramic member 9 has an indentation 23 which is spaced from the peened end portion 19 of the eyelet 13. Thus, a first metal spacer washer 7 is inserted into the electrode 5, the indentation 23 of the ceramic member 9 is placed in contact with the first metal spacer 7 and a second metal spacer 11 is compressed and placed in contact with the ceramic member 9 within the electrode 5. Since the eyelet 13, cathode structure 15, ceramic member 9 and metal spring washer 21 were previously assembled, the cathode ray tube assembly is completed.

Thus, there has been provided a unique cathode support assembly especially adapted for use in cathode ray tube structures. The cathode support assembly is economical of labor and parts and suitable for use with prior known and used components. However, the unique cathode support assembly does provide an enhanced capability for reduction of microphonics in cathode ray tube structures.

While there has been shown and described what is at present considered the preferred embodiments of the invention, it will be obvious to those skilled in the art that various changes and modifications may be made therein without departing from the invention as defined by the appended claims.

What is claimed is:

1. A cathode support assembly for a cathode ray tube comprising:

an apertured ceramic member;

an apertured resilient spring washer having a normally curved contour;

a cathode assembly; and a dual diameter eyelet having said cathode assembly affixed to one end thereof and extending therethrough, an outwardly crimped portion and a peened end portion with said ceramic member and apertured resilient spring washer telescoped over said eyelet and disposed intermediate said outwardly crimped portion and said peened end portion of said eyelet whereby said ceramic member is fixedly disposed by a force exerted thereon by said apertured resilient spring washer and said outwardly crimped and peened end portions of said eyelet.

2. The cathode support assembly of claim 1 wherein said spring washer has a curved shape prior to exertion of a force thereon by said ceramic member and eyelet.

3. The cathode support assembly of claim 1 wherein said spring washer is supported by said crimped portion of said eyelet and said ceramic member is disposed intermediate said spring washer and said peened end portion of said eyelet.

4. The cathode support assembly of claim 1 wherein said ceramic member includes a substantially circular indentation and said peened end portion of said eyelet is in contact with said ceramic member and spaced from said indentation.

5. A process for fabricating a cathode support assembly for the cathode electrode of a cathode ray tube comprising the steps of:

forming an outwardly crimped portion on a dual diameter substantially circular eyelet having a cathode electrode affixed to one end thereof;

telescoping an apertured resilient spring washer having a normally curved contour over said dual diameter substantially circular eyelet and into contact with said outwardly crimped portion of said dual diameter substantially circular eyelet;

telescoping an apertured ceramic member over said dual diameter substantially circular eyelet and into contact with said apertured resilient spring washer; and peening the end of said dual diameter substantially circular eyelet to exert a force on said apertured ceramic member and said apertured resilient spring washer intermediate said peened end and said outwardly crimped portion of said dual diameter substantially circular eyelet; said force being in an amount to reduce the curvature of said normally curved contour of said apertured resilient spring washer whereby a resilient force exists between said dual diameter substantially circular eyelet and said apertured ceramic member.

6. The process of claim 5 wherein said ceramic member includes a substantially circular indentation and said end of said eyelet is peened into contact with said ceramic member and spaced from said indentation.

7. The process of claim 5 wherein said spring washer is of steel with a thickness of about 0.010 inches.

8. A process for fabricating a cathode support assembly for a cathode ray tube comprising the steps of:

forming an outwardly crimped portion on a dual diameter substantially circular eyelet;

telescoping an apertured ceramic member over said dual diameter substantially circular eyelet and into contact with said outwardly crimped portion of said dual diameter substantially circular eyelet;

telescoping an apertured resilient spring washer having a normally curved contour over said dual diameter substantially circular eyelet and into contact with said apertured ceramic member; and peening the end of said dual diameter substantially circular eyelet to exert a force on said apertured ceramic member and said apertured resilient spring washer intermediate said outwardly crimped portion and said peened end of said dual diameter substantially circular eyelet; said force being in an amount sufficient to reduce said normally curved contour of said apertured resilient spring washer whereby a resilient force exists between said dual diameter substantially circular eyelet and said apertured ceramic member.

* * * * *